US009616255B1

(12) United States Patent
Liddle

(10) Patent No.: US 9,616,255 B1
(45) Date of Patent: Apr. 11, 2017

(54) SAFETY RESTRAINT ANCHOR SYSTEM

(75) Inventor: James Liddle, Omaha, NE (US)

(73) Assignee: Skytie, Inc., Omaha, NE (US)

( * ) Notice: Subject to any disclaimer, the term of this patent is extended or adjusted under 35 U.S.C. 154(b) by 0 days.

(21) Appl. No.: 13/469,878

(22) Filed: May 11, 2012

Related U.S. Application Data

(60) Provisional application No. 61/484,718, filed on May 11, 2011.

(51) Int. Cl.

| | |
|---|---|
| ***A47L 3/04*** | (2006.01) |
| ***A62B 1/16*** | (2006.01) |
| ***A62B 35/00*** | (2006.01) |
| ***A63B 29/02*** | (2006.01) |
| ***E06C 7/18*** | (2006.01) |
| ***A62B 1/00*** | (2006.01) |
| *B61B 7/00* | (2006.01) |
| *E04G 3/28* | (2006.01) |
| *E04G 3/00* | (2006.01) |
| *A45D 19/04* | (2006.01) |
| *A47J 47/16* | (2006.01) |
| *F16M 11/00* | (2006.01) |
| *F16M 13/00* | (2006.01) |
| *A63G 1/28* | (2006.01) |
| *A47D 13/04* | (2006.01) |
| *A62B 1/06* | (2006.01) |
| *A62B 1/18* | (2006.01) |

(52) U.S. Cl.
CPC ..... *A62B 1/00* (2013.01); *A62B 35/0062* (2013.01); *A62B 1/06* (2013.01); *A62B 1/16* (2013.01); *A62B 1/18* (2013.01); *A62B 35/005* (2013.01); *A62B 35/0037* (2013.01); *A62B 35/0043* (2013.01); *A62B 35/0068* (2013.01); *A62B 35/0075* (2013.01); *A62B 35/0081* (2013.01); *A62B 35/0087* (2013.01)

(58) Field of Classification Search
CPC ... A62B 35/0081; A62B 35/0062; A62B 1/06; A62B 1/16; A62B 1/18; A62B 35/0037; A62B 35/0043; A62B 35/0075; A62B 35/0068; A62B 35/005; A62B 1/00; E04G 21/32; E04G 21/3204; E04G 21/3214; E04G 21/3219; E04G 21/3223; E04G 21/3228; A63G 1/28; A63G 1/12; A63G 1/30; A63G 1/24; A63G 1/26; A63G 1/36; A63G 9/12; A63G 1/42; A63G 4/00; A63G 1/20; B66C 1/12; A61H 3/00; A63B 7/00; A63B 21/068; A63B 21/154; A63B 22/0046; A63B 69/0035; A63B 71/0009; A64B 71/0009
USPC ..... 248/127, 148, 158, 536; 182/2.11, 3, 5, 182/9, 45, 10, 36, 187; 472/33; 482/69; 119/701
See application file for complete search history.

(56) References Cited

U.S. PATENT DOCUMENTS 2,433,807 A * 12/1947 Bartlett ..... A63G 1/28 472/33
2,525,458 A * 10/1950 Peterson ..... A63G 1/28 472/3
3,332,132 A * 7/1967 Johnson et al. ..... 29/897.33
3,910,403 A * 10/1975 Morsbach et al. ..... 198/685
(Continued)

*Primary Examiner* — Brian Mattei
*Assistant Examiner* — Taylor Morris
(74) *Attorney, Agent, or Firm* — Suiter Swantz pc llo

(57) ABSTRACT

A safety restraint anchor system may include, but is not limited to: a pole portion; a circumferential frame portion disposed about an axis of the pole; and at least one safety line anchor.

18 Claims, 5 Drawing Sheets

(56) References Cited

U.S. PATENT DOCUMENTS

| | | | | | |
|---|---|---|---|---|---|
| 4,550,801 | A * | 11/1985 | Forrest | 182/7 | |
| 4,714,135 | A * | 12/1987 | Bell | A62B 1/06 | 182/6 |
| 6,028,566 | A * | 2/2000 | Pennell | H01Q 1/1242 | 248/219.3 |
| 6,668,977 | B2 * | 12/2003 | Arsenault | 182/187 | |
| 6,695,095 | B1 * | 2/2004 | Franke | 182/3 | |
| 7,252,315 | B2 * | 8/2007 | Liberato | B66C 1/127 | 182/142 |
| 7,537,085 | B2 * | 5/2009 | Vetesnik | 182/3 | |
| 7,666,103 | B2 * | 2/2010 | Pondorfer | A63G 1/28 | 472/33 |
| 7,699,140 | B2 * | 4/2010 | Beggrow et al. | 182/36 | |
| 2002/0017427 | A1 * | 2/2002 | Guenette et al. | 182/3 | |
| 2008/0277557 | A1 * | 11/2008 | Vetesnik et al. | 248/499 | |
| 2010/0252365 | A1 * | 10/2010 | Feller | B66C 1/12 | 182/231 |

* cited by examiner

SAFETY RESTRAINT ANCHOR SYSTEM

RELATED APPLICATIONS

This application claims priority to U.S. Provisional Application No. 61/484,718 filed May 11, 2011, entitled "SAFETY RESTRAINT ANCHOR SYSTEM" by James Liddle which is hereby incorporated by reference in its entirety to the extent not inconsistent herewith.

FIELD OF THE INVENTION

This invention relates generally to systems and methods for anchoring safety restraints to prevent injury in the event of a fall by a user.

SUMMARY OF THE INVENTION

In an embodiment of the invention, a safety restraint anchor system may include, but is not limited to: a pole portion; a circumferential frame portion disposed about an axis of the pole; and at least one safety line anchor.

BRIEF DESCRIPTION OF THE DRAWINGS

The numerous objects and advantages of the present invention may be better understood by those skilled in the art by reference to the accompanying figures in which.

DETAILED DESCRIPTION

At constructions sites, workers may be required to carry out their work at heights substantially above a grade level or lower floor level (e.g. on floor joists, foundation walls, etc.). Such heights increase the risk of injuries due to falls from these elevated work areas. As such, fall protection measures may be employed to prevent such injuries. Previous fall prevention structures have included pre-constructed railings, scaffolding, and the like. To perform this work efficiently, it is undesirable to pre-construct such static safety structures each time construction workers are required to move to a new area of the construction site. As such, it is desirable to provide a safety restraint anchor system configured to allow wide access to various work areas of a construction site while providing fall protection.

Figure 1:
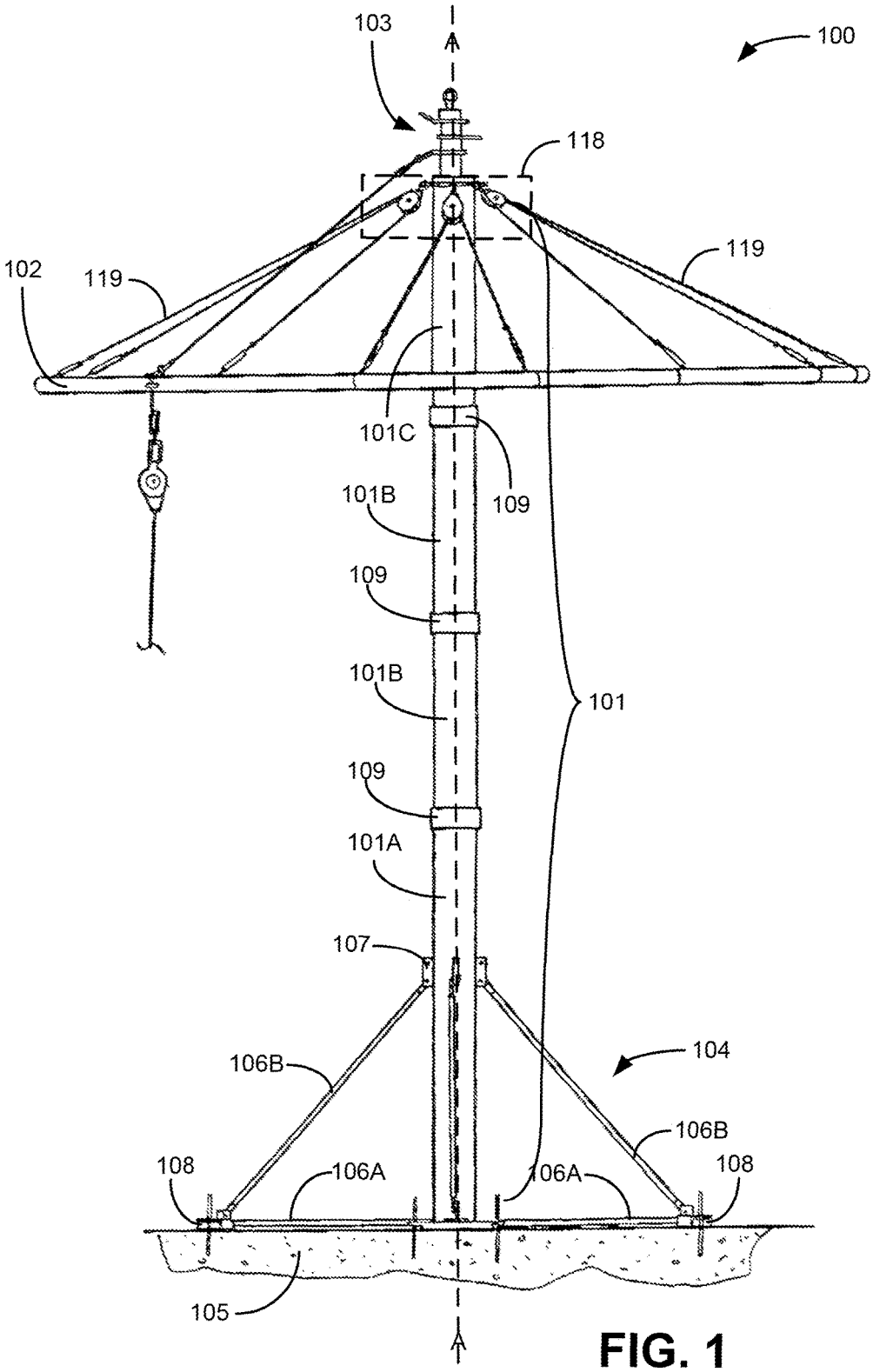
FIG. 1 depicts a side view of an erected safety restraint anchor system.

Referring to FIG. 1, a safety restraint anchor system 100 is illustrated. The safety restraint anchor system 100 may include a substantially vertical pole portion 101, a circumferential frame portion 102 disposed about an axis "A" of the pole portion 101 (e.g. in a plane perpendicular to the axis of the pole portion 101) and at least one safety line anchor mechanism 103 disposed substantially atop the pole portion 101.

The pole portion 101 may be comprised of a base section 101A, one or more extension sections 101B and a cap section 101C. The base section 101A, extension sections 101B and cap section 101C may be constructed of any sturdy material (e.g. 6" steel tubing) and may be of varying lengths (e.g. 8' to 13' in length).

Figure 2:
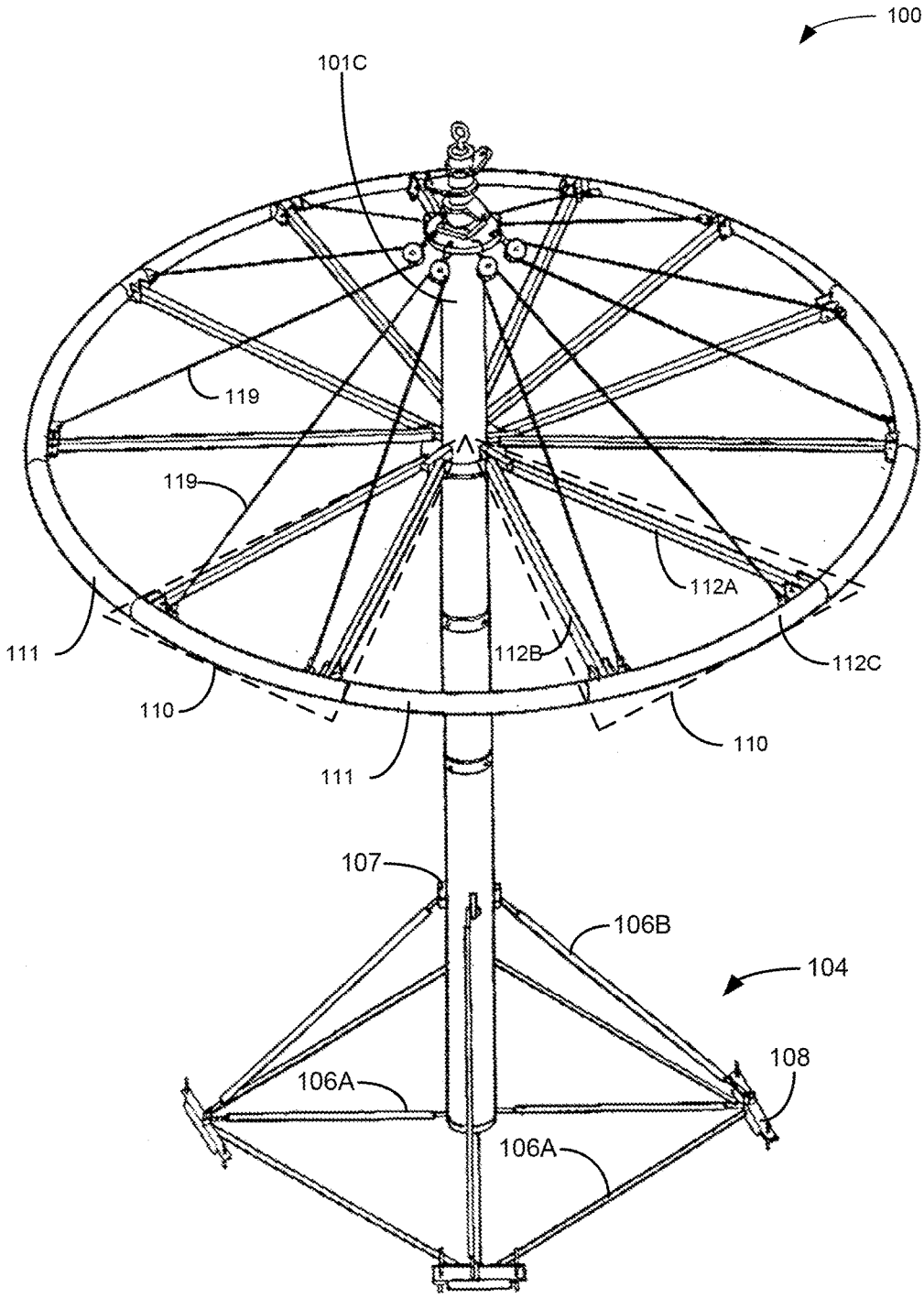
FIG. 2 depicts a perspective view of a safety restraint anchor system.

Referring to FIGS. 1 and 2, the base section 101A may be coupled to a base support 104 configured to orient the base section 101A in a substantially vertical position relative to a construction base surface 105 (e.g. a bare earth surface, a foundation surface, a subfloor surface, etc). The base support 104 may include one or more truss members 106 (e.g. horizontal extension arm truss members 106A and/or angled brace truss members 106B) which may be operably coupled to one or more flanged portions 107 of the base section 101A and/or one or more base support foot portions 108.

Each of the extension sections 101B and the cap section 101C may include a collar portion 109 having an inner diameter greater than an outer diameter of a portion of the extension sections 101B and/or the base section 101A so as to receive the extension sections 101B and/or the base section 101A within the collar portion 109 to extend the height of the safety restraint anchor system 100 to a desired elevation. An extension section 101B and/or the base section 101A may be received within cap section 101C to bring the safety restraint anchor system 100 to its final operational height.

Figure 3:
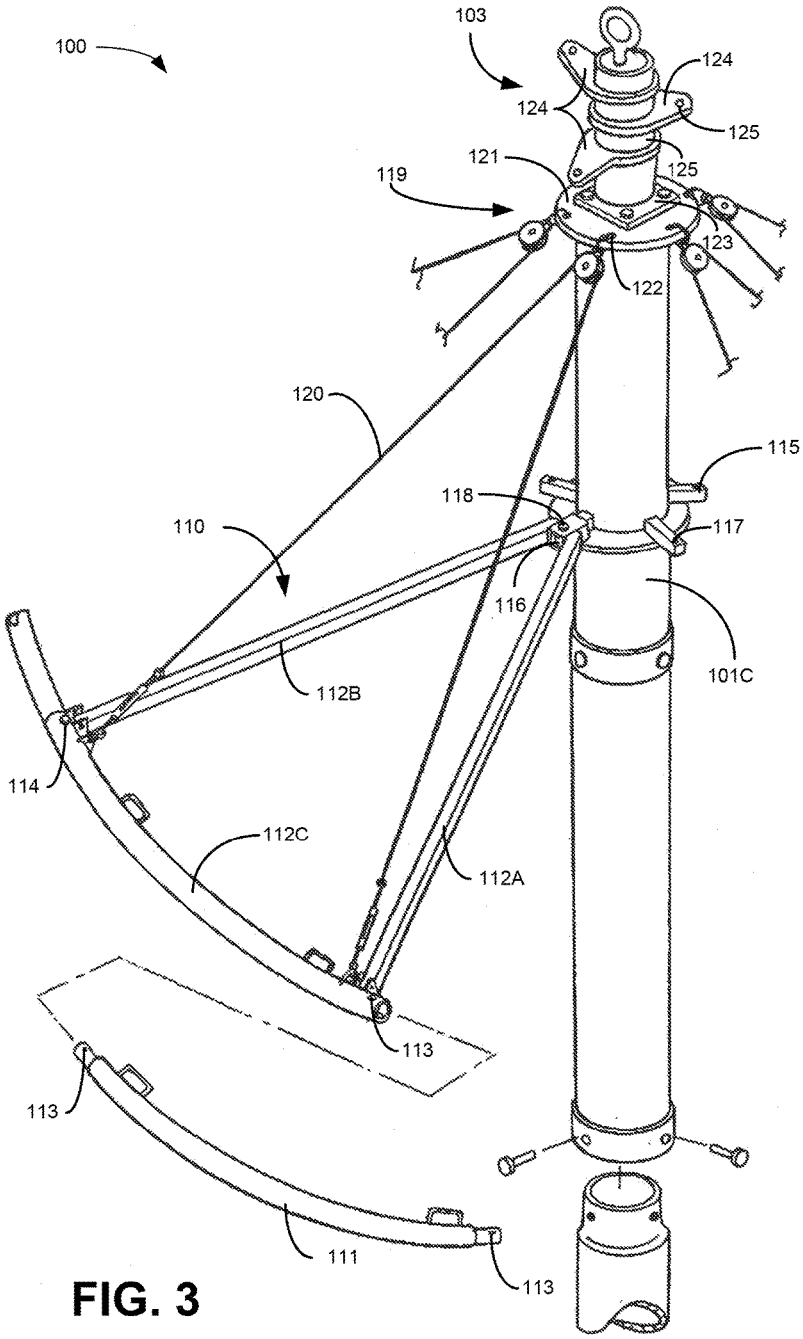
FIG. 3 depicts an exploded view of a safety restraint anchor system.

As shown in FIGS. 2 and 3, the safety restraint anchor system 100 may include one or more trusses 110 and one or more arcuate portions 111. The trusses 110 may be combined with one or more arcuate portions 111 to form the circumferential frame portion 102. For example, the trusses 110 may be pie-shaped including a first radial truss member 112A, a second radial truss member 112B, and arcuate truss member 112C connecting the distal ends of the first radial truss member 112A and the second radial truss member 112B. The trusses 110 and/or the arcuate portions 111 may each include one or more locking bolt apertures 113. The locking bolt apertures 113 of the trusses 110 and the arcuate portions 111 may be co-aligned to receive a locking bolt 114 so as to operably couple the trusses 110 and the arcuate portions 111. In a particular embodiment, six arcuate portions 111 and six trusses 110 may be alternated to complete the circumferential frame portion 102.

As further shown in FIG. 3, the cap section 101C may include one or more truss mounts 115. The trusses 110 may include a projection defining a truss mounting aperture 116. The truss mounting aperture 116 of a truss 110 may be sized to fit around the truss mounts 115 to secure a truss 110 to the cap section 101C. The truss mounts 115 and the trusses 110 may further include truss locking apertures 117. The truss locking apertures 117 of the truss mounts 115 and the trusses 110 may be co-aligned so as to receive a locking bolt 118 thereby removably coupling the truss mounts 115 to the trusses 110. Though truss mounts 115 and the trusses 110 are shown in a male/female configuration, the truss mounts 115 and the trusses 110 may alternately employ a female/male configuration without departing from the scope of the invention.

As further shown in FIG. 3, the cap section 101C may include a guy wire mount 119 for affixing one or more guy wires 120 to the cap section 101C. The guy wire mount 119 may include at least one flanged portion 121 extending substantially radially from the cap section 101C. The flanged portion 121 may include one or more coupling apertures 122. The guy wire 120 may be coupled to the coupling apertures 122 of the guy wire mount 119 via a connector (e.g. a carabineer-type connector). An end of the guy wire 120 opposite the guy wire mount 119 may be coupled to a truss 110 and/or an arcuate portion 111 so as to secure the circumferential frame portion 102 in position relative to the pole portion 101.

Referring again to FIG. 3, the cap section 101C may further include the safety line anchor mechanism 103. The safety line anchor mechanism 103 may include a base portion 123 which may be operably coupled to the top of the cap section 101C. The safety line anchor mechanism 103 may further include central shaft portion (not shown). One or more rotatable safety line connectors 124 including a shaft receiving aperture (not shown) may be placed on the shaft. One or more spacers 125 may separate the safety line connectors 124 to allow for the free rotation of the safety line connectors 124 about the axis of the central shaft portion. While shown with three safety line connectors 124, it will be appreciated that the safety line anchor mechanism 103 is extensible to any number of safety line connectors 124. Each safety line connector 124 may include a safety line coupling aperture 126. A safety line 127 may be coupled to the safety line coupling aperture 126 via a connector routed through the safety line coupling aperture 126.

Figure 4:
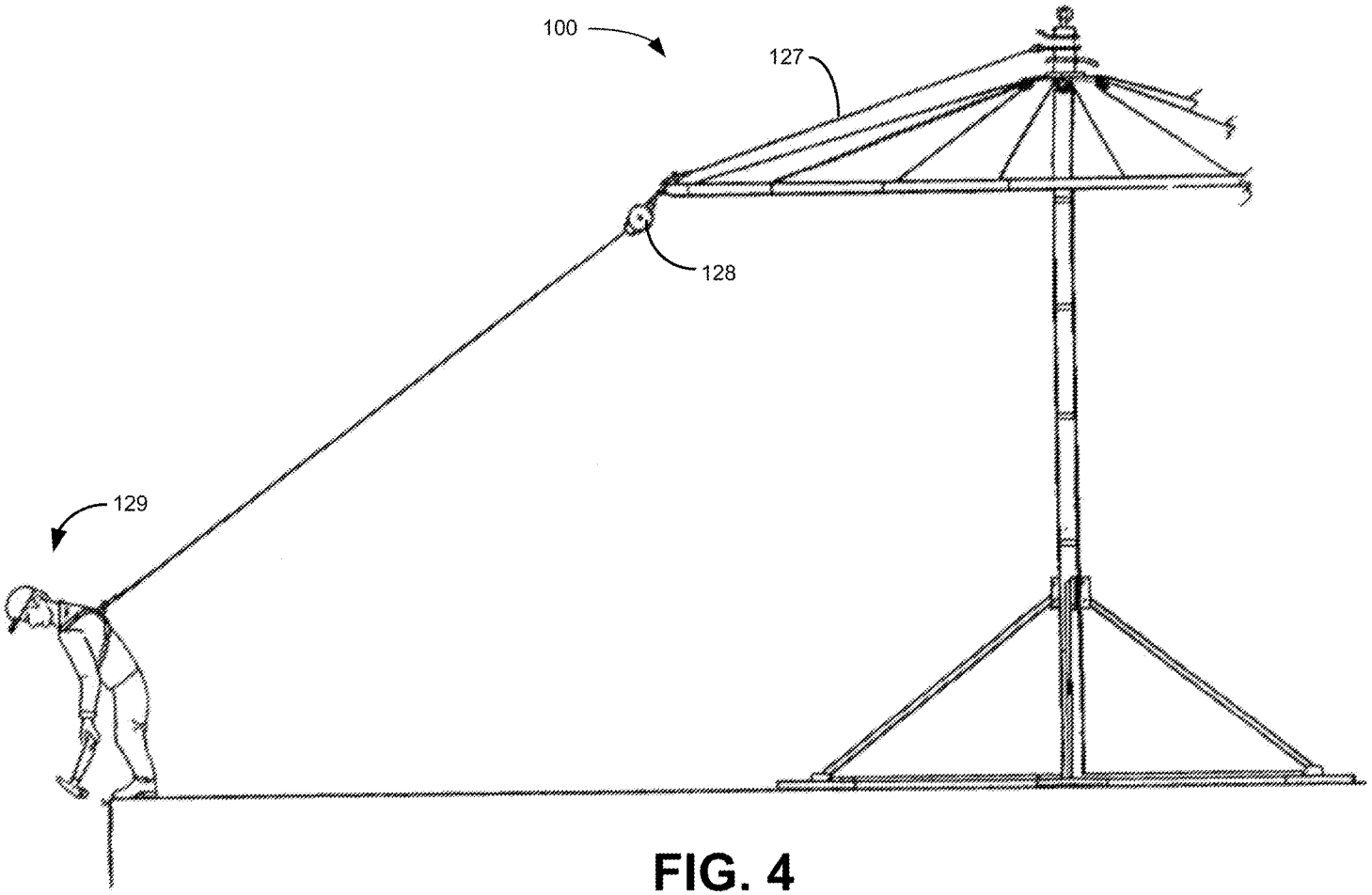
FIG. 4 depicts a side view of an operation mode of a safety restraint anchor system.
Figure 5:
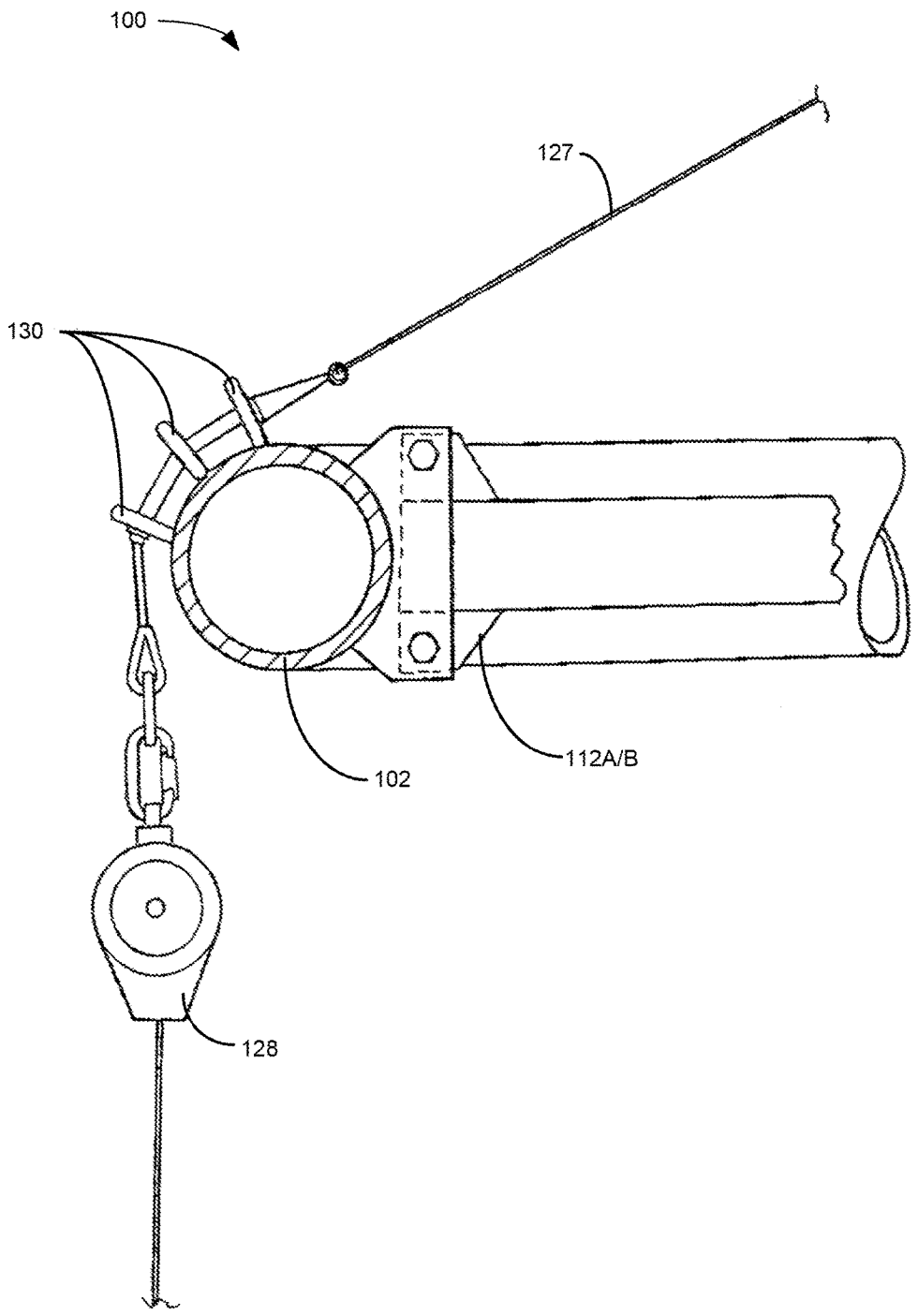
FIG. 5 depicts a cross sectional view of a safety restraint anchor system.

As shown in FIGS. 4-5, the safety line 127 may be routed from the safety line anchor mechanism 103 down over the circumferential frame portion 102 where it may be connected to a fall arrest mechanism 128. The fall arrest mechanism 128 may be a retractable safety line device configured extent and retract during normal operation but lock into a static position when a sudden force is applied (i.e. in the event of a fall by a user 129 coupled to the fall arrest mechanism 128). As shown in FIG. 5, the safety line 127 may include one or more rollers 130. The rollers may be coupled to the safety line 127 at a position such that the rollers 130 contact the circumferential frame portion 102 when the safety line 127 is connected to the safety line anchor mechanism 103. The rollers 130 may freely rotate about the safety line 127 so as to allow the safety line 127 to easily move around the circumferential frame portion 102.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A safety restraint anchor system comprising:

a stationary base support configured to be fixed to a base surface;

a pole configured to be supported by the stationary base support;

a continuous frame;

one or more support members extending from the pole to the continuous frame and statically coupling the continuous frame to the pole such that the frame surrounds an axis defined by a length of the pole;

at least one safety line connector operably coupled to the pole;

one or more safety lines having a first end operably coupled to the at least one safety line connector, the at least one safety line being routed over and in contact with the continuous frame; and at least one user harness operably coupled to a second end of the at least one safety line.

2. The system of claim 1, wherein the pole portion comprises:

a base portion; and a cap portion.

3. The system of claim 2, wherein the pole portion further comprises:

an extension portion.

4. The system of claim 1, wherein the continuous frame includes:

at least one arcuate portion operably coupled to the one or more support members.

5. The system of claim 1, wherein the one or more support members include:

one or more support members extending radially from the pole to the frame substantially within a plane defined by the frame portion.

6. The system of claim 4, wherein at least one support member is operably coupled substantially proximate to an end of the at least one arcuate portion.

7. The system of claim 1, further comprising:

one or more guy wires operably coupled to the pole and at least one of the continuous frame or the one or more support members.

8. The system of claim 1, wherein a plane defined by the continuous frame does not intersect the at least one safety line anchor.

9. The system of claim 1, wherein the one or more support members extend radially from the pole to the continuous frame substantially within the plane defined by the continuous frame.

10. The system of claim 1, wherein the continuous frame defines a plane substantially perpendicular to the axis defined by the length of the pole.

11. The system of claim 1, wherein the one or more support members retain the continuous frame in a substantially static position relative to the pole.

12. The system of claim 1, wherein the at least one safety line connector operably coupled to the pole includes:

two or more safety line connectors operably coupled to the pole.

13. The system of claim 12, wherein the two or more safety line anchors operably coupled to the pole include:

a first safety line connector including an at least partially upward projecting portion; and a second safety line connector including an at least partially downward projecting portion.

14. The system of claim 1, wherein the at least one safety line connector operably coupled to the pole includes:

at least one safety line connector rotatable about the axis defined by the length of the pole.

15. The system of claim 1, wherein the at least one safety line is configured to move laterally across the continuous frame.

16. The system of claim 1, wherein the continuous frame defines a plane that intersects the pole.

17. The system of claim 1, wherein the continuous frame includes:

at least a first portion and a second portion operably coupled together.

18. A method for anchoring a safety line comprising:

supporting a pole via a stationary base support fixed to a base surface;

coupling a first end of a safety line to the pole;

statically coupling a continuous frame to the pole via one or more support members extending from the pole such that the continuous frame surrounds an axis defined by a length of the pole; and routing the safety line over the continuous frame such that a portion of the safety line contacts the continuous frame;

coupling a second end of the safety line to a user harness.

* * * * *